US007470845B2

(12) United States Patent
Fermie et al.

(10) Patent No.: US 7,470,845 B2
(45) Date of Patent: Dec. 30, 2008

(54) MUSICAL SHAKER

(75) Inventors: Bart Fermie, Amsterdam (NL); Jan Roelof van der Meulen, Brunssum (NL)

(73) Assignee: Pearl Musical Instrument Co., Chiba (JP)

( * ) Notice: Subject to any disclaimer, the term of this patent is extended or adjusted under 35 U.S.C. 154(b) by 0 days.

(21) Appl. No.: 11/657,115

(22) Filed: Jan. 24, 2007

(65) Prior Publication Data

US 2008/0173155 A1 Jul. 24, 2008

(51) Int. Cl.
*G10D 13/08* (2006.01)

(52) U.S. Cl. ..... 84/402; 446/418

(58) Field of Classification Search ..... 84/402, 84/418; D17/22; 446/418–421; D21/406
See application file for complete search history.

(56) References Cited

U.S. PATENT DOCUMENTS

| | | | | |
|---|---|---|---|---|
| 1,348,836 | A | 8/1920 | Patremio | |
| 2,112,316 | A | 3/1938 | Turner | |
| 2,289,314 | A | 7/1942 | Davis | |
| 2,399,333 | A | 4/1946 | Desmond | |
| 2,473,574 | A | 6/1949 | Davis | |
| 3,384,990 | A | 5/1968 | Romand | |
| 3,521,518 | A | 7/1970 | Cohen | |
| 3,566,737 | A * | 3/1971 | Gussak | 84/402 |
| 3,657,465 | A | 4/1972 | Koishikawa | |
| 4,179,973 | A | 12/1979 | White | |
| 4,244,267 | A | 1/1981 | Nemeth | |
| 4,361,980 | A | 12/1982 | Chatani | |
| 4,968,283 | A | 11/1990 | Montgomery | |
| 5,309,174 | A | 5/1994 | Minkus | |
| 5,309,586 | A | 5/1994 | Sies et al. | |
| 5,476,408 | A | 12/1995 | Hoeting et al. | |
| 5,483,859 | A | 1/1996 | Singer | |
| 5,659,143 | A | 8/1997 | Isackson | |
| 6,620,991 | B1 * | 9/2003 | Honiball | 84/402 |
| 6,682,393 | B1 | 1/2004 | Puett, III | |
| 6,858,787 | B1 | 2/2005 | De Vries | |
| 2001/0047715 | A1 | 12/2001 | Rice | |

* cited by examiner

*Primary Examiner*—Walter Benson
*Assistant Examiner*—Jianchun Qin
(74) *Attorney, Agent, or Firm*—Berenato, White & Stavish

(57) ABSTRACT

A percussion instrument, such as a shaker, has a first disc-shaped member having an outer annular flange defining a first outer perimeter and a second disc-shaped member defining a second outer perimeter different than the first outer perimeter. The first and second disc-shaped members are directly interconnected to form a cavity therebetween. A plurality of sound producing particles is disposed within said cavity defined by the first and second disc-shaped members. The instrument also includes a mounting system for mounting to a vehicle such as a tambourine, hi-hat, cymbal etc. for causing movement of the shaker instrument.

6 Claims, 2 Drawing Sheets

MUSICAL SHAKER

BACKGROUND OF THE INVENTION

1. Field of the Invention

The invention relates generally to a sound producing percussion instrument, in general, and to such an instrument which produces sounds in accordance with the operation of a drum (or the like) with a selectively variable tonal quality, in particular.

2. Description of the Prior Art

The prior art comprises many percussion instruments and many combinations thereof to effect varying sounds, tonal qualities and sound combinations. For example, in many cases drums, for example, are arranged to include therewith appropriate cymbal arrangements. These cymbal arrangements can be operated by means of a foot pedal or the like whereby the cymbals are selectively brought together to produce cymbal sound. While the operator of the instrument may obtain different sound patterns as a function of his skill in operating the instrument, nevertheless, the sounds are very similar and variations therein are difficult to achieve.

Another instrument used in percussion is a tambourine which, effectively, includes a ring with small cymbals arranged thereon. In the known tambourines, the ring may be independent or, conversely, a membrane may be stretched across one side thereof so that the tambourine may be selectively struck by the user thereof. The tambourine produces a different type of sound from the cymbal arrangement discussed above and is frequently desired in a percussion rendition of a musical score. However, the tambourines which are known in the art require the user to hold the tambourine and shake or hit the instrument to produce a sound. This requirement, of course, forces the user to have one hand occupied which substantially precludes concurrent drumming or other percussion instrument operation. Moreover, the sound produced by the tambourine is very difficult to reproduce accurately in normal operation.

The maraca is frequently used in the rhythm section of orchestras or other musical groups and is used to establish rhythm in musical performances of all kinds. The maraca as is well known is comprised of a generally spherical dried and hollowed gourd or the like encasing dried seeds or other pellets that produces a "rattle" type percussion sound when it is shaken. The user holds the maraca by a long, narrow stem that is attached by various means to the body of the maraca casing.

Due to the fact that the casing of the maraca is regularly shaped, the tone of the "rattle" sound created by shaking it is invariable. The spherical shape additionally makes it difficult to store and carry the instrument. Additionally, the frequently used natural casing materials are extremely frangible, requiring the user to exercise great care in handling a maraca. The manufacture of a maraca is also relatively time consuming and cumbersome.

The need exists for an improved percussion instrument that produces sound when shaken.

SUMMARY OF THE INVENTION

A percussion instrument, such as a shaker, comprises a first disc-shaped member having an outer annular flange defining a first outer perimeter and a second disc-shaped member defining a second outer perimeter different than the first outer perimeter. The first and second disc-shaped members are directly interconnected to form a cavity therebetween, and a plurality of sound producing particles are disposed within the cavity defined by the first and second disc-shaped members.

An aperture may be provided in the disc-shaped members to enable the shaker to be attached to a suitable support member such as a tambourine body, a hi-hat system and the like.

DETAILED DESCRIPTION OF PREFERRED EMBODIMENT

The present invention relates generally to musical percussion instruments of the "rattle" type that are held in the hand of the user and shaken or attached to a movable instrument (e.g., a hi-hat or cymbal) to produce a musical tone series of musical tones and particularly to such an instrument for generating tones or series of tones associated with the rhythm portion of musical instrumentation. The tones generated by the device constructed in accordance with the preferred embodiment of the present invention are useful in encouraging people to dance and for creating and establishing a rhythm for dancing, as an aid in instructing dancing, as an accompaniment during dancing and any other similar musical use. It is also considered within the scope of this invention that the shaker disclosed herein can be embodied as a child's toy, an amusement device or any other similar type sound generating instrument.

Figure 1:
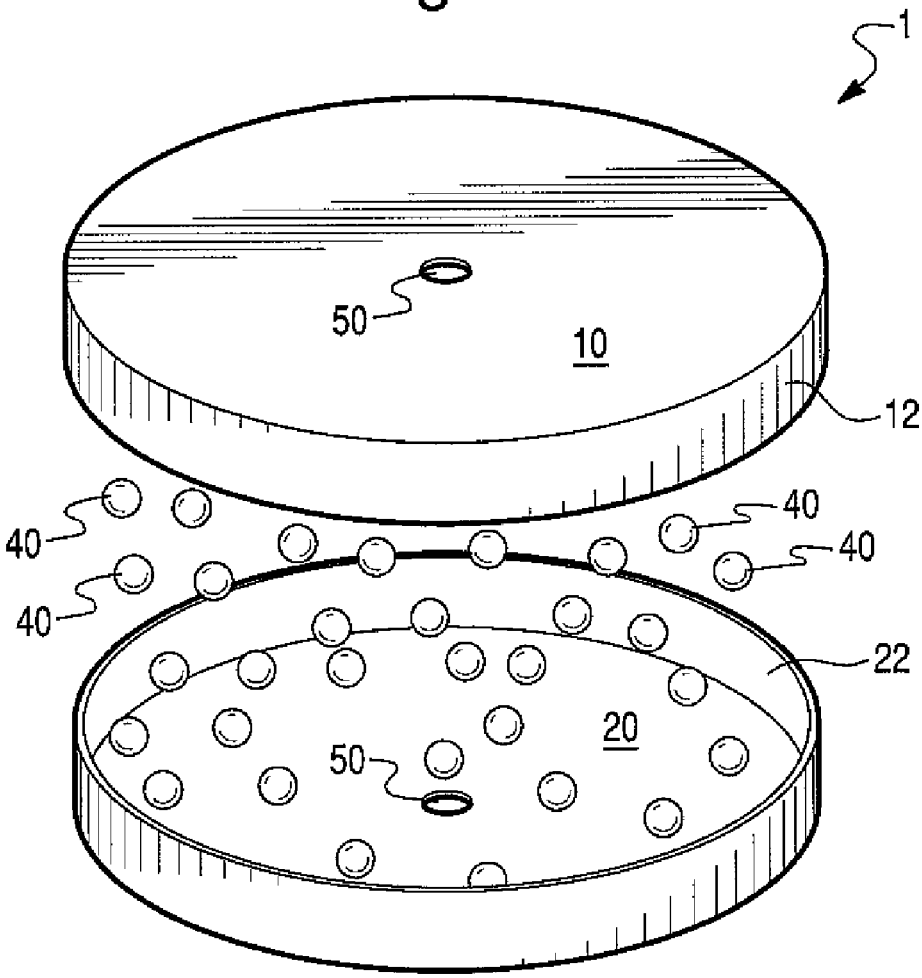
FIG. 1 is an exploded view of the disc-shaped shell members and sound producing particles disposed therebetween.
Figure 2:
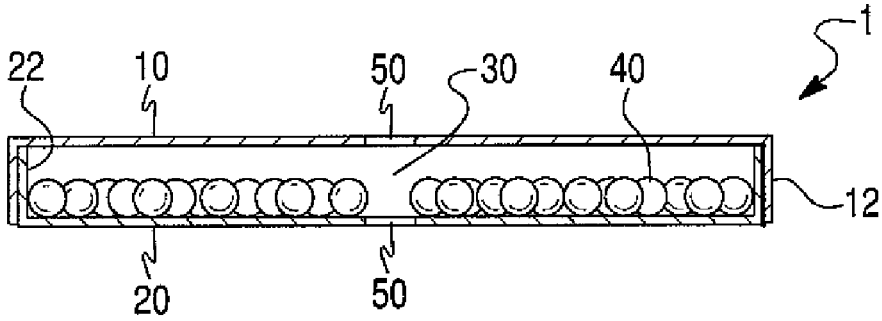
FIG. 2 is a cross sectional view of the shaker formed by the members illustrated in FIG. 1.

With reference to FIG. 1, the shaker 1 consists of two disc-shaped shell members 10, 20 that are press-fit or otherwise secured together and sealingly interconnected to form a cavity 30 therebetween. A plurality of sound producing particles 40 are disposed within the cavity 30 defined by the first and second disc-shaped members. FIG. 2 is a cross section view of the shaker 1 with the disc-shaped shell members 10, 20 assembled together, and FIG. 2 shows the dimensions of an outer perimeter for each disc-shaped shell members 10, 20. As further shown in FIGS. 1 and 2, the first disc-shaped shell member 10 has a first outer annular flange 12 defining a first outer perimeter, while the second disc-shaped shell member 20 has a second outer annular flange 22 defining a second outer perimeter different than the first outer perimeter. Preferably, the first and second disc-shaped members 10 and 20 are directly interconnected so that the second outer annular flange 22 of the second disc-shaped member 20 is press fit into the first outer annular flange 12 of the first disc-shaped member 10 to form the cavity 30 therebetween.

The sound producing particles 40 are contained between the two disc-shaped shell members 10, 20 and move freely within the cavity 30. The sound producing particles 40 are adapted and dimensioned so that they can freely travel in a space or an open area between the first and second shell members 10, 20, and accordingly, they are operative for producing sounds as they strike the inner walls of the shell members when the shaker is moved or shaken. Moreover, the sound producing particles 40 may be in the form of ball bearings, beads, kernels, seeds, peas, rice, sand, etc. The sound producing particles 40 can be made of any appropriate material, such as metal, plastic or wood.

Figure 3:
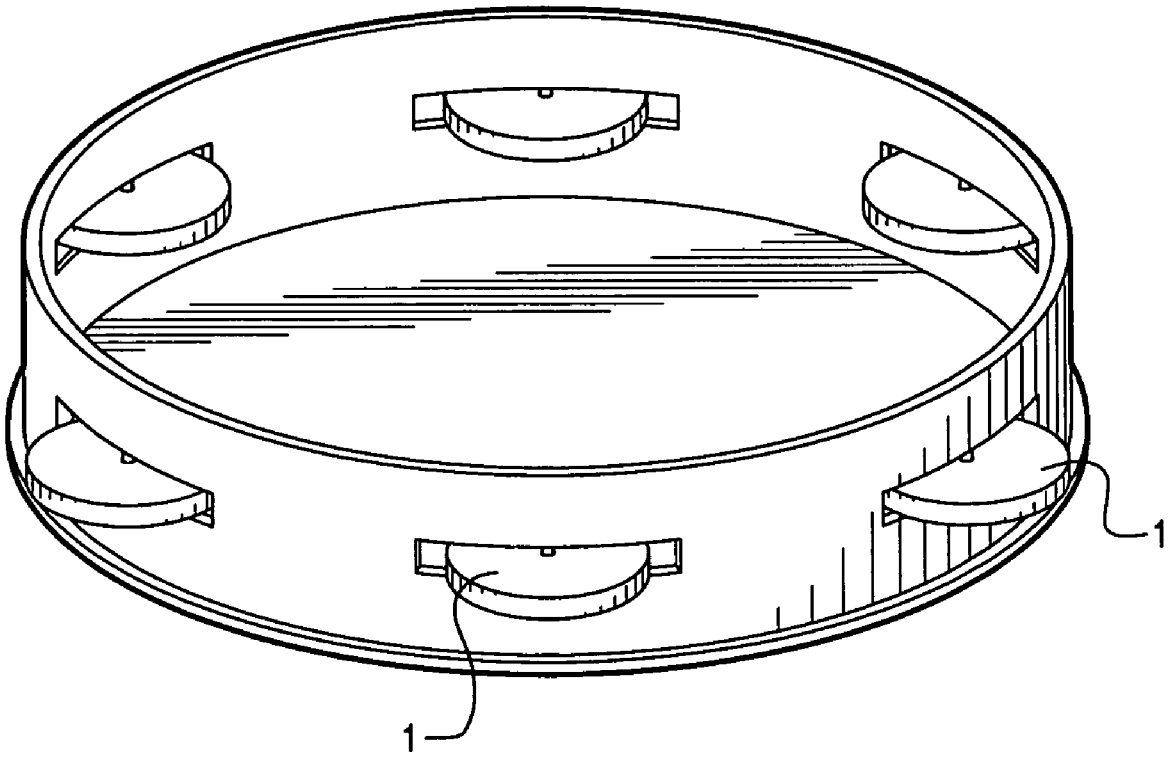
FIG. 3 is a tambourine having the shaker members of the present invention mounted thereto in a conventional manner.

From the foregoing description, it will be apparent to those of skill in the art that the present invention can be attached to tambourines, tambourine-type instruments, wristbands, sticks, hi-hats, cymbals, and other vehicles that when shaken or moved create a unique sound. For example, the shaker 1 may be disposed on a traditional tambourine as shown in FIG. 3 to provide a unique and enhanced percussion instrument. In the preferred embodiment, mounting apertures 50 are provided in at least one of the disc-shaped members 10, 20 for mounting the shaker 1 to a vehicle such as a tambourine, hi-hat, cymbal, etc. It will be understood that other mounting structures may be provided in place of the apertures 50. For example, a clamp may be employed to mount the shaker 1 to a cymbal or hi-hat in the same manner that a cow bell may be mounted to a drum stand or other component.

While the invention has been described with respect to the presently preferred embodiment, it will be understood by those skilled in the art after understanding the invention that various changes and modifications in form and detail may be made without departing from the scope of the appended claims.

The invention claimed is:

1. A percussion instrument, comprising:

a first disc-shaped member having a first outer annular flange defining a first outer perimeter;

a second disc-shaped member defining a second outer perimeter different than said first outer perimeter, wherein said first and second disc-shaped members are directly interconnected to form a cavity therebetween;

a plurality of sound producing particles disposed within said cavity defined by said first and second disc-shaped members; and a mounting system for mounting said instrument to a vehicle for shaking said percussion instrument to create sound, said mounting system comprising an aperture through at least one of the first and second disc-shaped members;

said first outer annular flange circumscribing said second outer perimeter of said second disc-shaped member.

2. The instrument according to claim 1, wherein said first disc-shaped member is sealingly interconnected with said second disc-shaped member.

3. The instrument according to claim 1, wherein said sound producing particles are chosen from a group consisting of ball bearings, beads, kernels, seeds, peas, rice, and sand.

4. The instrument according to claim 1, wherein said sound producing particles are metal.

5. The instrument according to claim 1, wherein said sound producing particles are plastic.

6. The instrument according to claim 1, wherein said sound producing particles are wooden.

* * * * *